US005172647A

United States Patent [19]

Towne

[11] Patent Number: 5,172,647

[45] Date of Patent: Dec. 22, 1992

[54] TAPE REINFORCED MONOFILM SAIL

[75] Inventor: Stephen F. Towne, Tampa, Fla.

[73] Assignee: Towne Yacht Survey, Inc., Tampa, Fla.

[21] Appl. No.: 766,808

[22] Filed: Sep. 26, 1991

[51] Int. Cl.[5] ..... B63H 9/06

[52] U.S. Cl. ..... 114/103

[58] Field of Search ..... 114/102, 103, 39.1

[56] References Cited

U.S. PATENT DOCUMENTS

| | | | |
|---|---|---|---|
| 3,680,519 | 8/1972 | Jalbert | 114/103 |
| 3,820,493 | 6/1974 | Amick | 114/102 |
| 3,954,076 | 5/1976 | Fracker | 114/103 |
| 3,974,791 | 8/1976 | Haarstick et al. | 114/103 |
| 4,624,205 | 11/1986 | Conrad | 114/103 |
| 4,702,190 | 10/1987 | Conrad | 114/103 |
| 4,708,080 | 11/1987 | Conrad | 114/103 |
| 4,815,409 | 3/1989 | Conrad | 114/103 |
| 4,831,953 | 5/1989 | Conrad | 114/103 |
| 4,945,848 | 8/1990 | Linville | 114/103 |
| 5,061,553 | 10/1991 | Olsen | 114/39.1 |

*Primary Examiner*—Jesus D. Sotelo
*Assistant Examiner*—Stephen P. Avila

[57] ABSTRACT

A high performance sail for racing and cruising sailboats, sailboards, iceboats and sailing land craft comprising of one, two or a plurality of panels seamed by double faced adhesive tape, with said panel(s) reinforced with a plurality of multi-filiment reinforced adhesive tapes, with the tapes radiating from the head and clew of the sail to the foot and luff of the sail.

1 Claim, 2 Drawing Sheets

TAPE REINFORCED MONOFILM SAIL

BACKGROUND

1. Field of Invention

This invention relates to sailboat sails, especially to a novel construction of high performance sails for propulsion of racing and cruising sailboats, sailboards, iceboats and land sailing craft.

2. Description of Prior Art

High performance sails have these fundemental characteristics: light weight, high strengh and low stretch. The degree to which these characteristics are achieved, along with the sails cut and workmanship, determines the ultimate performance of the sail. Heretofore, high performance sails, which is a very crowded art, have been produced to achieve these characteristics by using one of the following methods; 1) either a single woven sailcloth, such as Dacron, Kevlar, Nylon or Spectra; or a laminated composite sailcloths, consisting predominately of Mylar film backed with Dacron, Kevlar or Spectra woven material( Mylar is a film and Dacron is a fabric thread material of a polyester polymer, Kevlar is a fabric thread material of an aramid polymer, and Nylon is a fabric thread material of polyamides; Mylar, Dacron, Kevlar and Nylon are trademarks of the Dupont Company of Wilmington, Del.; Spectra is a polyolefin polymer fiber and Spectra is a trademark of the Allied Corperation of Morristown, N.J.); with a panel orientation aligning the major force lines with warp threads (since they will bear loads better than the weft threads); or 2) by laminating individual threads, aligned with the major force lines on a plurality of panels interconnecting the head, tack and clew, in between a layer of Mylar and another layer of Mylar or a layer of woven Dacron, Kevlar or Spectra material; or 3) finally by using lighter weight laminate or woven sailcloths reinforced with an intricate layout of structural members sewn to sail interconnecting the head ,tack and clew of the sail to bear the load forces of the sail.

All of these construction techniques are very labor and materials intensive with much wastage using very expensive woven and laminated sailcloths resulting in high priced sails. Other problems with these techniques exist, including: 1) the problem of laminate sails delaminating, resulting in expensive repairs or complete loss of use of the sail; 2) Kevlar, even with its high strength to weight characteristic, is susceptiable to distortion and breakdown due to flexing of the material; And 3) a panal width is usually limited to a maximum of 36 inches for most sailcloths, requiring broadseaming and an large number of panels in the sail.

BRIEF SUMMARY OF INVENTION

It has now been found that by using a monofilm material reinforced with multi-filiment reinforced tape instead of using a woven or composite sailcloth a high performance sail can be produced that is very inexpensive. Many sailors would find it desireable to have a high performance sail with low cost.

Accordingly several objects and advantages of my invention are: to provide a high performance sail that costs much less than prior art high performance sails, to provide a high performance sail of light weight construction, to provide a high strength sail design, to provide a high performance sail that can and has won races, to provide a high performance sail that is easier to produce and much less labor intensive, to provide a sail that requires a smaller number of panels with fewer seams, less material wasted and that requires no broadseaming of the panels, to provide a sail that is very durable and repairs easily, to provide a sail that is very reliable, to provide a sail that enhances visability on the boat due to its transparent monofilm panels, to provide a sail that is very novel to prior art sails, to provide a high performance sail with a high excitement factor and one that would be commercially successful and is successful at this time in marketing tests in the Tampa Bay Area.

Readers will find further objects and advantages of the invention from a consideration of the ensuing description and the accompaning drawings.

DRAWING FIGURES

DRAWING REFERENCE NUMERALS

Figure 1:
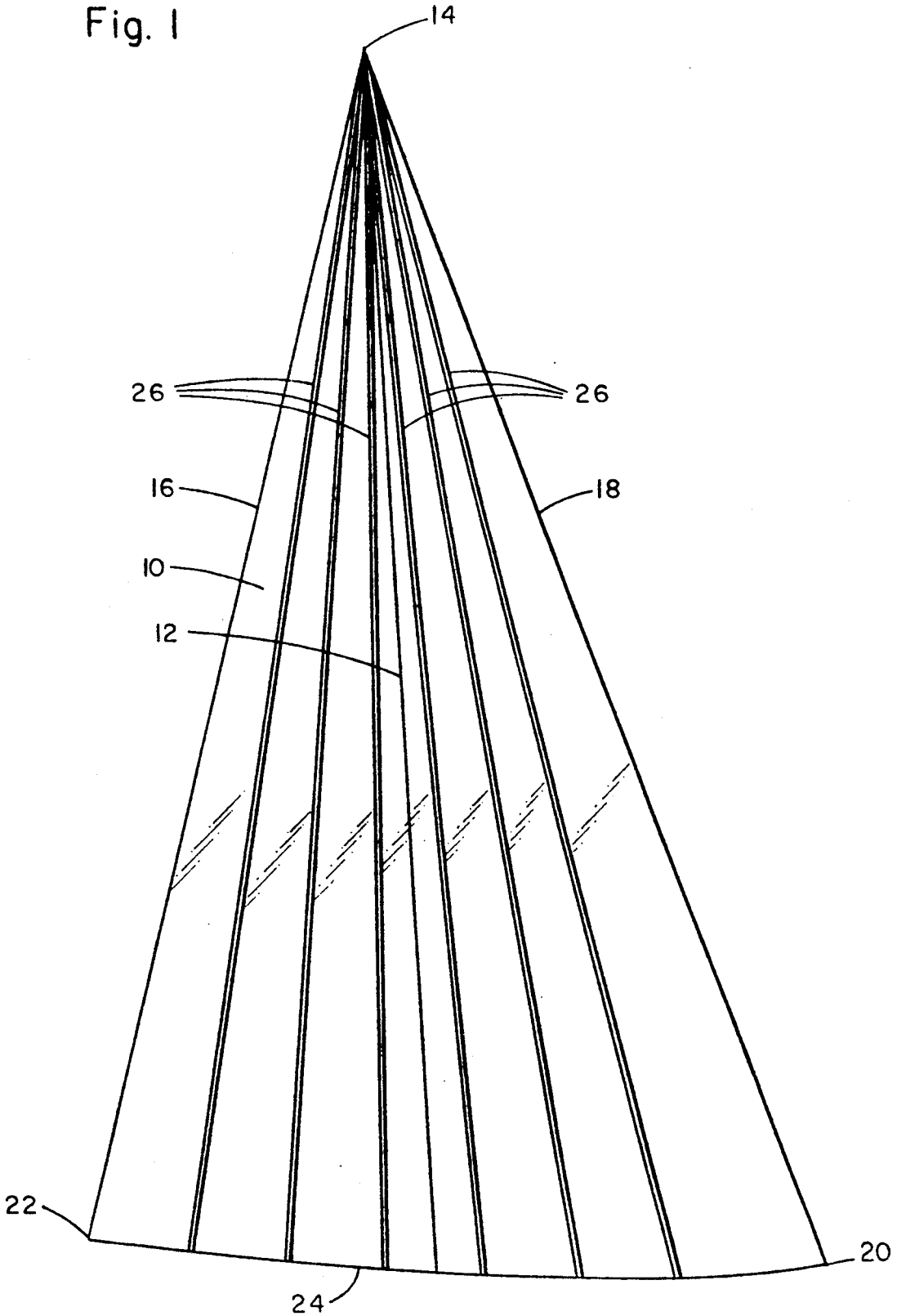
FIG. 1 shows a plan view, rightside of sail

10 monofilm panel
12 panel seam
14 head
16 leech
18 luff
20 tack
22 clew
24 foot
26 multi-filiment reinforced adhesive tape

High Preformance Sail—Description

Figure 2:
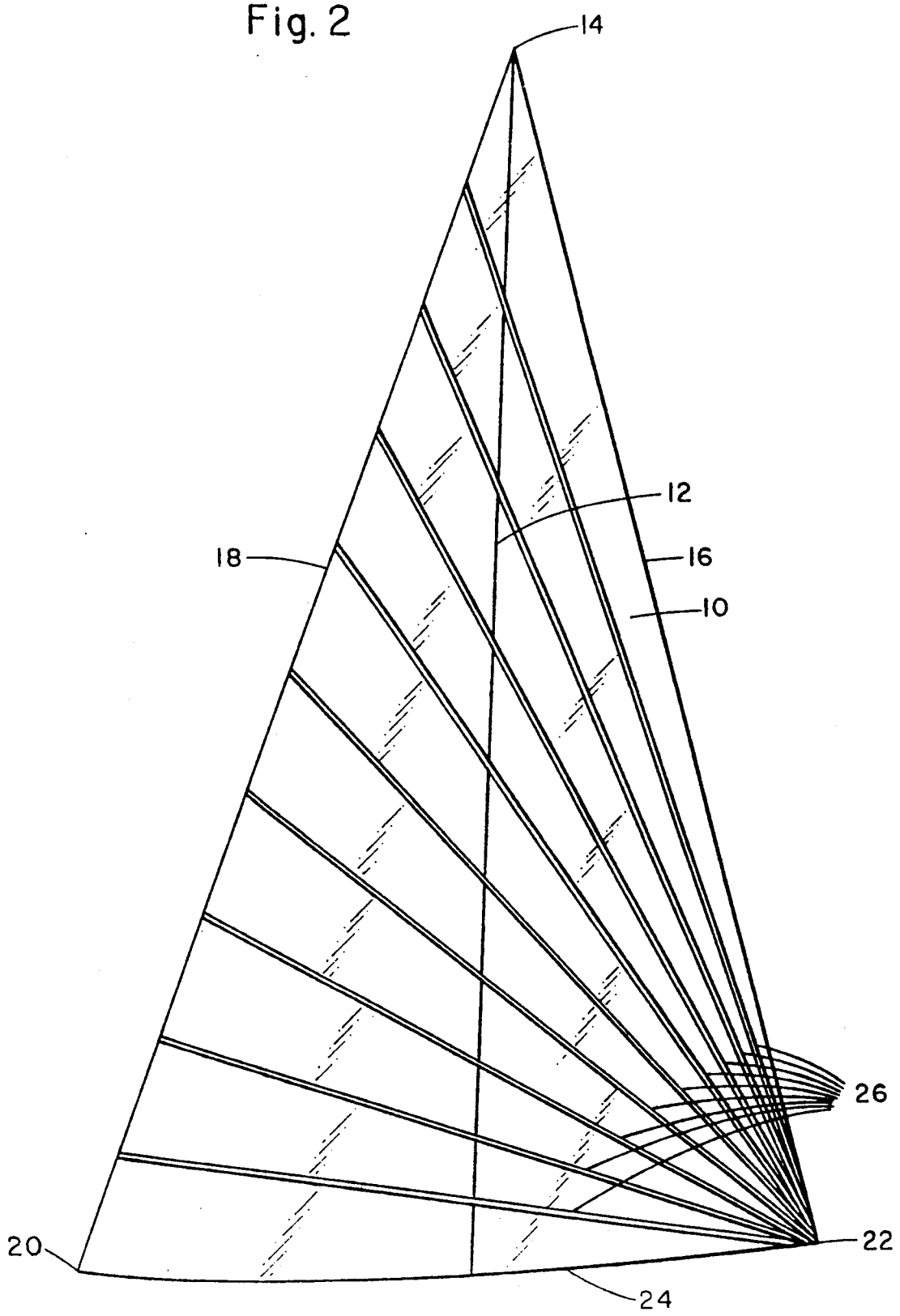
FIG. 2 shows a plan view, leftside of sail

FIG. 1 and FIG. 2 shows a high performance sail according to the preferred embodiment of the invention. The sail comprimises of single, double or plurality of approximately 70 inch wide monofilm panels 10 made of Mylar film seamed with double faced adhesive tape securing the panel seams 12. The leech 16, luff 18 and foot 24 curves, faired edges of the sail, are drawn in and the excess material is trimmed away. Multi- filiment reinforced adhesive tape 26 is then applied to the sail, radiating from the head 14 to the foot 24 on the rightside of the sail FIG. 1 and radiating from the clew 22 to luff 18 on the leftside of the sail FIG. 2., forming a bi-axiel pattern on the monofilm panels 10 of the sail. The sail is finished by adding whatever additional features are required for the particular sail, such as: corner reinforcements, batten pockets, luff and foot tapes, means for attaching the sail to the mast and boom or headstay, leech tape, contains the leech line for tensioning the leech to stop fluttering of the leech 16, reef points, clew ring, attachment point of the clew 20, tack ring, attachment point of the tack 22 and headboard, attachment point of the head of the sail, and any other features the sail order specifies, using techiques of sailmaking well known in the art.

According to the present invention, a high performance sail is constructed that has the following characteristics: 1) is lightweight, 2) has a high strenth to weight ratio sail design allowing use of the sail throughout the full wind range with minimum distortion, 3) is of monofilm construction and seamed by double faced adhesive tape with no stiching or welds in the.main body of the sail, a technique of construction previously unattained in the prior art, 4) has fewer panels due to wider monofilm material available requiring less seaming and, 5) reduces the labor required to manufacture the sail by eliminating the sewing of the panels together, 6) increases visibilty of the vessel making navigation safer due to the transparent nature of the sail, 7) is produced with off-the-shelf materials very inexpensively priced eliminating the need for manufactured woven and laminated sailcloths, 8) makes production greatly simplifed allowing the sail to be made for much less money.

While the above description contains many specificities, the reader should not construe these as limitations on the scope of the invention, but merely as exemplifications of preferred embodiments thereof. Those skilled in the art will envision many other possible variations are within its scope. For example skilled artisans will readily be able to change the material of the sail to alternate materials such as light weight composite laminates or woven sailcloths or substitute different multi-filiment reinforcing tapes.

Accordingly the reader is requested to determine the scope of the invention by the appended claims and their legal equivalants, and not by the examples which have been given.

What is claimed is:

1. As an article of manufacture, a high performance sail, comprising: at least two sail panels forming said sail with a head, a foot, a clew, a luff, and sides, a plurality of multi-filament reinforced adhesive tapes adhering to and reinforcing each said panels, said tapes having a pattern radiating out of and interconnecting the head of the sail with the foot of the sail on one side of the sail, and on the otherside of the sail said tapes having a different patern radiating out of and interconnecting the clew of the sail with the luff of the sail.

* * * * *